United States Patent [19]

Merson

[11] 3,987,740

[45] Oct. 26, 1976

[54] PORTABLE SEAM LOCKING DEVICE

[76] Inventor: Karol J. W. Merson, 1307 Crossfield Bend, Mississauga, Canada, L5G 3P4

[22] Filed: Mar. 28, 1975

[21] Appl. No.: 562,954

[52] U.S. Cl. ..... 113/54 R; 29/243.58; 113/57

[51] Int. Cl.[2] ..... B21D 39/02

[58] Field of Search ..... 29/243.57, 243.58; 113/54, 56, 57; 173/123

[56] References Cited

UNITED STATES PATENTS

| | | | |
|---|---|---|---|
| 1,898,069 | 2/1933 | Tschudi | 173/123 |
| 2,131,821 | 10/1938 | Schlicht | 113/56 |
| 2,143,339 | 1/1939 | Wiese | 113/56 |
| 2,252,017 | 8/1941 | McCrery | 173/123 |
| 2,810,420 | 10/1957 | Gibson | 113/54 |
| 3,213,817 | 10/1965 | Hunziker | 113/54 |
| 3,421,356 | 1/1969 | Buske | 113/54 |
| 3,602,032 | 8/1971 | Skintzis | 113/54 |
| 3,777,687 | 12/1973 | Colman | 29/243.58 |
| 3,808,869 | 5/1974 | Raymond | 113/56 |

*Primary Examiner*—Lowell A. Larson
*Attorney, Agent, or Firm*—Fetherstonhaugh & Co.

[57] ABSTRACT

A portable seam locking device which is mountable on a portable hand tool. The device provides a support anvil for supporting the flanges which are to be folded and a hammer for bending one flange with respect to the other to perform the required fold over seam joint between two metal flanges. The hammer is mounted in the housing of the device for oscillating movement with respect to the anvil. The head of the anvil is formed with a small ridge on its inner surface which serves to form a series of crimps in the joint which prevent longitudinal slipping between the components of the joint.

6 Claims, 6 Drawing Figures

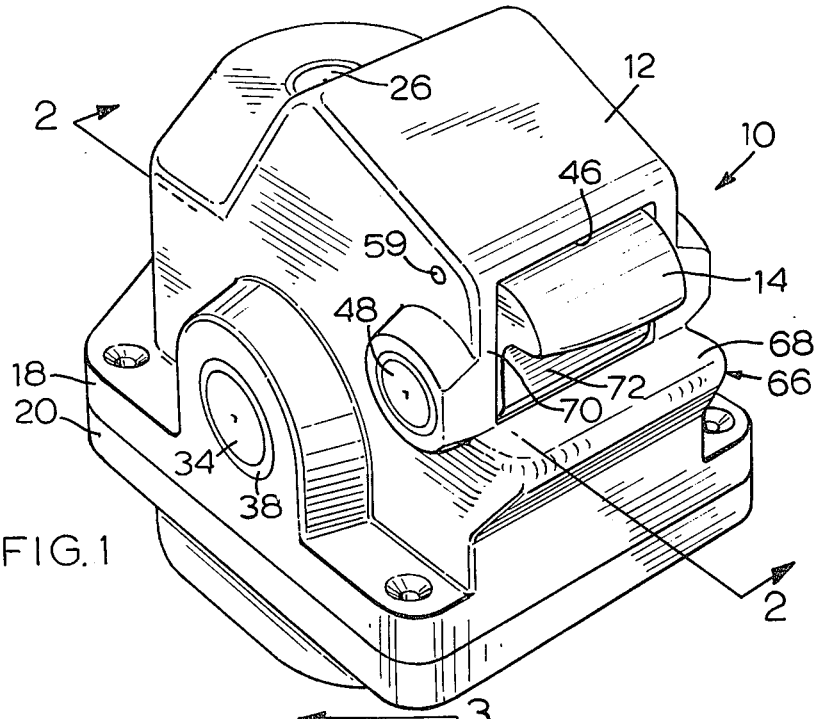
FIG. 1
FIG. 2
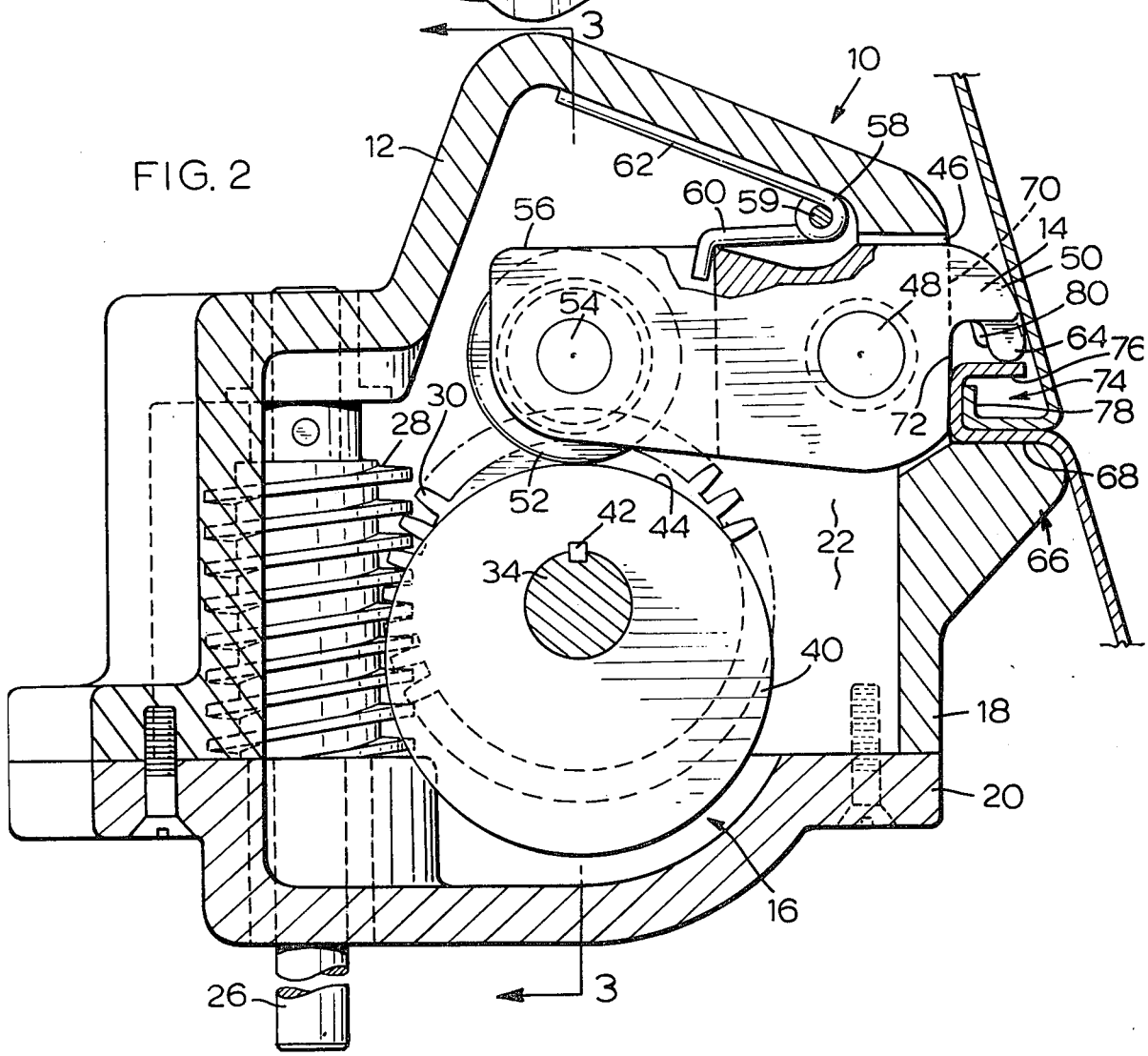

PORTABLE SEAM LOCKING DEVICE

FIELD OF INVENTION

This invention relates to metal forming tools. In particular, this invention relates to a seam forming tool for forming a fold-over seam between sheet metal flanges.

PRIOR ART

In my copending application Ser. No. 179,775, now U.S. Pat. No. 3,716,812, I have described a fold-over seam joint for sheet metal structures which is simple in form and which provides an effective joint between sheet metal structures. The formation of this joint in the assembly of fabricated metal buildings by conventional methods is time-consuming.

Seams are formed between adjacent sheet metal components by preforming the flanges in a manner similar to that described in copending application Ser. No. 179,775 and thereafter forming the flanges to an interlocking relationship. In the initial forming of the flanges to the preformed configuration, the sheet metal is subjected to a substantial working and work hardening occurs. When the work hardened flanges are to be further formed, difficulty has been experienced in attempting to achieve the further forming by rotary forming rollers. In my copending Canadian application Ser. No. 204,429, I have described an apparatus in which these difficulties are overcome by providing a pair of roll formers arranged one behind the other. While this apparatus works successfully with light gauge sheet metal, I have found that considerable difficulty is experienced when attempting to form sheet metal of a heavier gauge.

SUMMARY OF INVENTION

The portable seam locking device of the present invention overcomes the difficulties of the prior art described above and provides a device which is simple to operate and which is effective in forming a seam joint between preformed sheet metal flanges of substantial thickness.

According to an embodiment of the present invention, a portable seam locking device for forming a fold-over seam joint between two metal flanges comprises a portable housing having an anvil surface disposed outwardly and extending longitudinally thereof and a hammer mounted for oscillating movement with respect to the housing and drive means within the housing for causing the hammer to oscillate rapidly to drive the head portion of the hammer towards the anvil surface to engage and deform the metal flanges into an interlocking relationship. The anvil surface is adapted to support the flange of the seam joint which is to be formed and the hammer has a head portion at one end thereof which is movable towards and away from the anvil in response to the oscillating movement of the hammer.

PREFERRED EMBODIMENT

Figure 6:
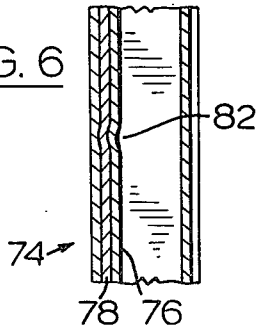
Figure 5:
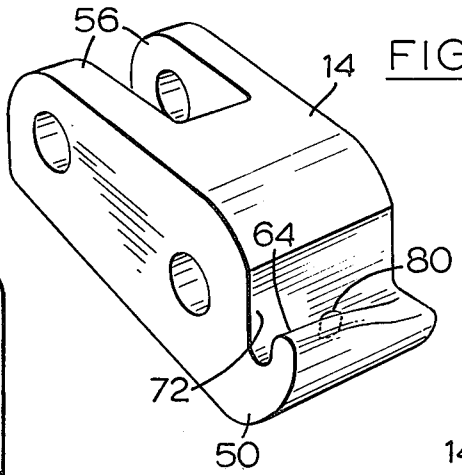
Figure 4:
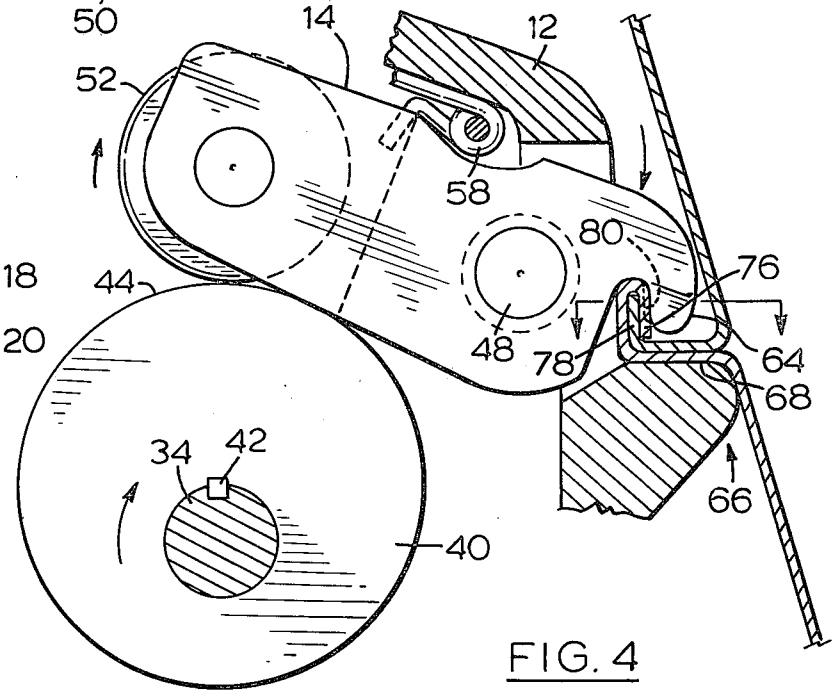
Figure 3:
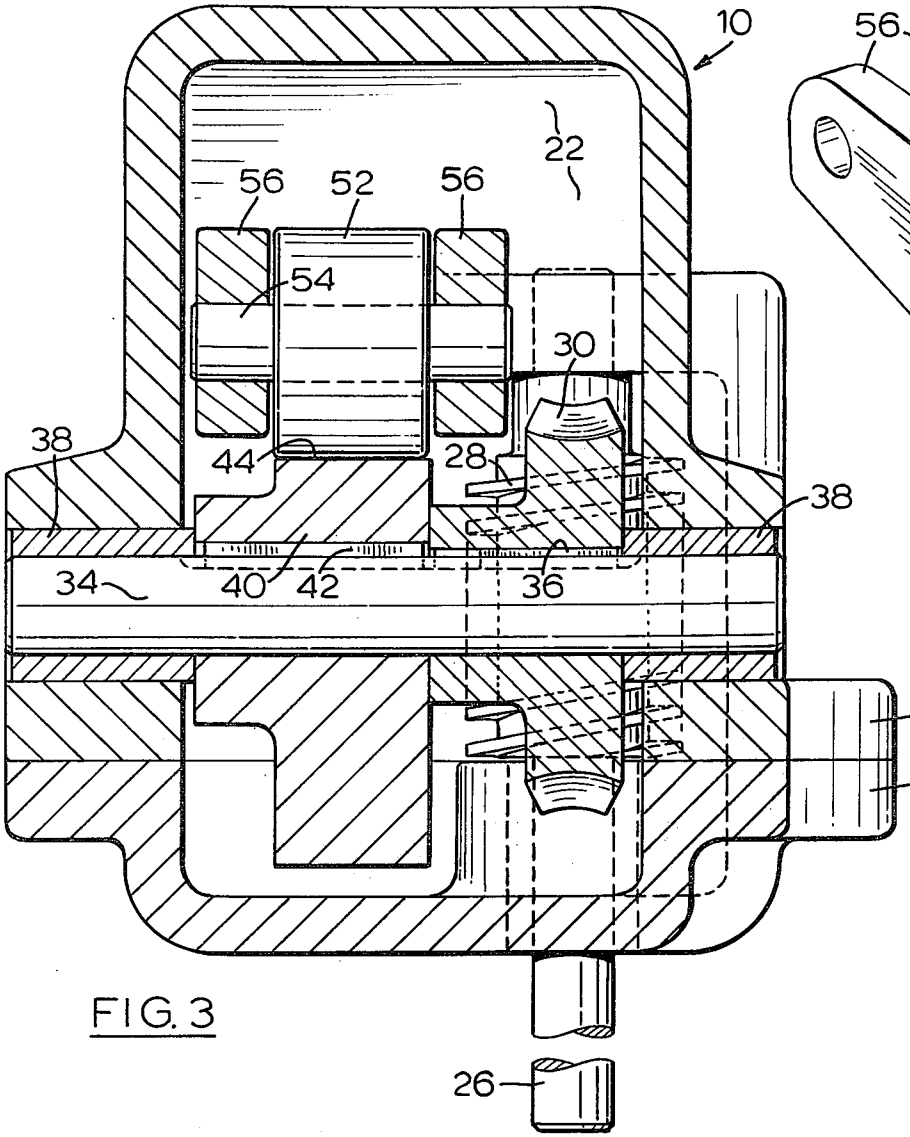

The invention will be more clearly understood after reference to the following detailed specification read in conjunction with the drawings wherein FIG. 1 is a perspective front view of a seam locking device according to an embodiment of the present invention, FIG. 2 is a sectional side view taken along the line 2—2 of FIG. 1, FIG. 3 is a sectional view taken along the line 3—3 of FIG. 1, FIG. 4 is an enlarged view illustrating the operation of the hammer in the formation of the seam, FIG. 5 is a pictorial view of the underside of a suitable hammer, and FIG. 6 is a longitudinal section taken through a locked seam illustrating the ridges formed to prevent longitudinal relative movement between the components of the joint.

With reference to the drawings, the reference numeral 10 refers generally to a portable seam locking device according to an embodiment of the present invention. The seam locking device 10 comprises a housing 12, a hammer 14 and a drive mechanism generally identified by the reference numeral 16. The housing 12 consists of a main body portion 18 and a detachable wall portion 20 which cooperate with one another to define a chamber 22 inwardly thereof. An input drive shaft 26 is mounted for rotation in the housing 12 and has one end projecting outwardly therefrom for engagement with a power tool such as the chuck of an electric hand drill or the like. A worm 28 is mounted on the shaft 26 within the chamber 22 and is rotatably driven by the shaft 26. The worm 28 is meshed with worm gear 30 to rotatably drive the worm gear 30. The worm gear 30 is keyed by means of a key 36 to shaft 34. The shaft 34 is mounted for rotation in bearings 38 which are supported by the housing 12. An eccentric cam 40 is mounted on the shaft 34 and secured for rotation therewith by means of a key 42. The cam 40 has a peripheral cam surface 44.

The housing 12 has a passage 46 opening outwardly therefrom through which the hammer 14 projects. The hammer 14 is pivotably mounted with respect to the housing 12 by means of a pivot pin 48. The hammer 14 has a head portion 50 at the outer end thereof. The inner end of the hammer 14 is bifurcated and a cam follower 52 in the form of a roller bearing is supported for rotation on a shaft 54 which is mounted and extends between the ends 56 of the hammer. A torque spring 58 has one arm 60 engaging the hammer 14 and another arm 62 engaging the housing 12. The torque spring 60 is biased to rotate the hammer so that the cam follower 52 is maintained in engagement with the cam track surface 44.

The head portion 50 of the hammer includes a ridge 64 which extends longitudinally thereof. The ridge 64 reduces in height towards one end thereof to facilitate the longitudinal feeding of the tool along the seam in use.

The housing 12 has portion. It L-shaped anvil surface generally identified by reference numeral 66 formed on an outer surface thereof. The L-shaped anvil surface includes a first wall portion 68 which projects laterally outwardly from and extends longitudinally of the housing and a second wall portion 70 which is disposed inwardly of and extends normal to the first wall portion.It will be noted that the hammer 14 has a wall portion 72 which extends in the plane of the wall portions 70 when the hammer is disposed in a first elevated position.

In use, when the hammer is in the elevated position shown in solid lines in FIG. 2, the upper surface of the ridge portion of the head cooperates with the walls 70, 72 and 66 to define an open U-shaped chamber which is adapted to receive a preformed partially interlocked flange of the type shown in broken lines and identified by the reference numeral 74.

Rotation of the cam 40 causes the hammer to oscillate about the pivot pin 48 to move the head 50 of the hammer between the first elevated position shown in solid lines and the second lowered position shown in FIG. 4. It is this oscillating movement of the head which causes the head to move the flange 76 of the preformed seam from its first position to a position engaging the second flange 78.

In use, the head is located in the first position so that the U-shaped channel is open to receive the partially preformed seam as shown in FIG. 2. Usually the operation will be started at one end of the seam with the seam being fed longitudinally inwardly of the U-shaped opening in a direction from the end at which the ridge is reduced in height. The drive shaft 26 is rotatably driven by means of a suitable power source such as a power drill to drive the worm which in turn drives the worm wheel which in turn drives the eccentric cam 40. Rotation of the eccentric cam 40 causes the cam follower 52 to rise and fall. Movement of the cam follower causes oscillating movement of the hammer about the pivot pin 48. The oscillating movement of the hammer causes the head portion 50 of the hammer to move between the first and second positions towards and away from the anvil surfaces to deform the portions of the preformed seam located therebetween to the interlocked position. The rotational speed of the input shaft determines the rate of oscillation of the head of the hammer. It has been found that speeds of up to strokes per minute provides an effective speed of operation. As the seam is formed between the head and the anvil, the housing is moved longitudinally of the seam over the full length of the seam. An important feature of the present invention is that the speed at which the mechanism is fed along the seam can be determined by the operator. Unlike the devices which employ power driven forming rolls, the device of the present invention is not self-propelling. As a result, no difficulty is experienced in feeding the device along the seam at a rate of advance which is commensurate with the rate at which the hammer is capable of deforming the seam to the interlocked position.

The interlocking seam joints in sheet metal are frequently weak in longitudinal direction so that longitudinal sliding between interlocked sheets is possible. The apparatus of the invention serves to overcome this difficulty by reason of the fact that the head portion of the hammer is formed with an inwardly directed protrusion 80. The protrusion 80 serves to form a series of ridges 82 (FIG. 6) which extend transversely of the longitudinal extent of the seam. The transverse ridges formed by the protrusions 80 serve to lock the seam against longitudinal sliding so that the seam has a substantial strength in the longitudinal direction.

These and other advantages of the present invention will be apparent to those skilled in the art.

I claim:

1. A portable seam locking device for forming a fold over seam joint between two metal flanges comprising, a. a portable housing having a recessed anvil surface formed on and extending longitudinally of an outer surface thereof, said anvil surface having first and second faces disposed perpendicular to one another in an L-shaped configuration, b. A hammer pivotably mounted in said housing for oscillating movement, between a first and second position, about a pivot axis which is disposed rearwardly from said second face at a level above said first face in a plane parallel to the plane of said anvil surface, c. said hammer having a head portion at one end thereof projecting outwardly from said housing to overlie said anvil surface, said head portion having a ridge portion which, when said hammer is in said first position, projects outwardly from the head portion in a direction towards said first face and is spaced outwardly from said second face of said anvil surface, d. said hammer being pivotable in response to movement to said second position to move said ridge in an arc which curves towards both said first and second faces whereby said ridge is disposed more closely adjacent both said first and second faces when in said second positions to draw a seam joint inwardly of said housing during folding thereof by engagement with said ridge, e. drive means within said housing engaging said hammer and causing said hammer to oscillate about said pivot point to move said head portion to and fro between said first and second positions, said drive means including input drive shaft means connectible to a source of rotary power.

2. A portable seam locking device as claimed in claim 1 wherein said drive means includes rotary cam means mounted witin said housing, said cam means being rotatably driven in response to rotation of said input drive shaft, and cam follower means mounted at the other end of said hammer and engaging said cam means whereby rotation of the cam means causes said hammer to oscillate as aforesaid.

3. A portable seam locking device as claimed in claim 1 wherein said ridge of said head portion decreases progressively in height in the longitudinal direction of said anvil surface thereof to facilitate longitudinal advancement of said head with respect to the seam to be formed.

4. A portable seam locking device as claimed in claim 1 and including passage means extending through said second wall portion, said hammer projecting through said passage means of said wall portion whereby said second wall portion forms an anvil support surface on opposite sides of said head portion of said hammer.

5. A portable seam locking device as claimed in claim 1 when said head is in said first position said ridge is spaced above said first above said first surface of said anvil surface to cooperate with said first and second anvil surfaces to define an elongated U-shaped slot opening outwardly from said housing to receive a partially preformed U-shaped interlocking seam of a sheet metal joint having an upper locking flange disposed in a position underlying said ridge portion of said hammer, whereby upon movement of said head to said ridge engages an underlying leg of said seam and folds it about an axis which is disposed above said first face of said anvil a distance greater than twice the thickness of the sheet metal from which the interlocking seam is formed whereby an L-shaped seam is formed.

6. A portable seam locking device as claimed in claim 1 wherein said ridge has an inner face directed towards said second face of said anvil, a protrusion formed on said inner face and extending perpendicular to the longitudinal extent of said second face to form a corresponding indentation in the seam formed by engagement with the ridge in use serving to prevent relative movement between the interlocked components of the seam in the direction of the longitudinal extent of the seam.

* * * * *